US011439562B1

(12) United States Patent
Beja Lezama et al.

(10) Patent No.: US 11,439,562 B1
(45) Date of Patent: Sep. 13, 2022

(54) CONTROLLED TRAJECTORY AND OSCILLATION SYSTEM DELIVERING PENDULAR MOVEMENT OVER THE GEOMETRY OF THE SYSTEM'S STRUCTURE

(71) Applicants: Benjamin Beja Lezama, Cruz de Huanacaxtle-Bahía de Bande (MX); Francisco Robles Robles, Mexico City (MX)

(72) Inventors: Benjamin Beja Lezama, Cruz de Huanacaxtle-Bahía de Bande (MX); Francisco Robles Robles, Mexico City (MX)

( * ) Notice: Subject to any disclaimer, the term of this patent is extended or adjusted under 35 U.S.C. 154(b) by 0 days.

(21) Appl. No.: 17/351,472

(22) Filed: Jun. 18, 2021

(30) Foreign Application Priority Data

May 4, 2021 (MX) ..... MX/a/2021/005264

(51) Int. Cl.

| | |
|---|---|
| ***A61H 1/00*** | (2006.01) |
| ***A63B 5/11*** | (2006.01) |
| ***A47C 3/02*** | (2006.01) |
| ***A47D 9/02*** | (2006.01) |
| ***A45F 3/22*** | (2006.01) |

(52) U.S. Cl.
CPC ..... *A61H 1/003* (2013.01); *A61H 1/005* (2013.01); *A63B 5/11* (2013.01); *A45F 3/22* (2013.01); *A47C 3/02* (2013.01); *A47D 9/02* (2013.01); *A61H 2201/12* (2013.01); *A61H 2201/14* (2013.01)

(58) Field of Classification Search
CPC ..... A61H 1/003; A61H 2201/12; A61H 2201/14; A61H 1/00; A61H 1/001; A61H 1/005; A61H 23/00; A61H 2201/0157; A61H 2201/1284; A61H 2201/1427; A63B 26/00; A63B 5/00; A63B 21/4029; A63B 22/14–18; A63B 26/003–2026/006; A47C 3/0252; A47C 21/006; A47C 3/0255; A47C 3/025; A45D 3/26; A47D 9/02; A47D 13/107; A45F 3/22; A45F 4/08; A45C 3/025; A45C 3/0255
USPC .... 297/314, 313, 261.1, 273, 276–277, 281, 297/282
See application file for complete search history.

(56) References Cited

U.S. PATENT DOCUMENTS 3,066,901 A * 12/1962 Jesson ..... A63B 55/60 248/205.1
3,117,760 A * 1/1964 Dresbach ..... A63B 1/00 248/188.5
5,107,556 A * 4/1992 Haider ..... A47C 21/006 5/124
5,295,930 A * 3/1994 Hogan ..... A63B 69/18 482/130

(Continued)

*Primary Examiner* — Tu A Vo
*Assistant Examiner* — Alexander Morales
(74) *Attorney, Agent, or Firm* — HEA Law PLLC; Darrin A. Auito

(57) ABSTRACT

The invention refers to a system of a plurality of pendulums with controlled oscillation and trajectory which delivers the oscillatory movement in the upper part of its geometry, where it is recovered and transferred to the desired object, be it a chair, a crib or a bed, and since this motion is transferred or projected from below, does not need suspension points external to the system or to the object for it to experience a stable and safe oscillatory motion.

7 Claims, 3 Drawing Sheets

(56) References Cited

U.S. PATENT DOCUMENTS

Figure 1:
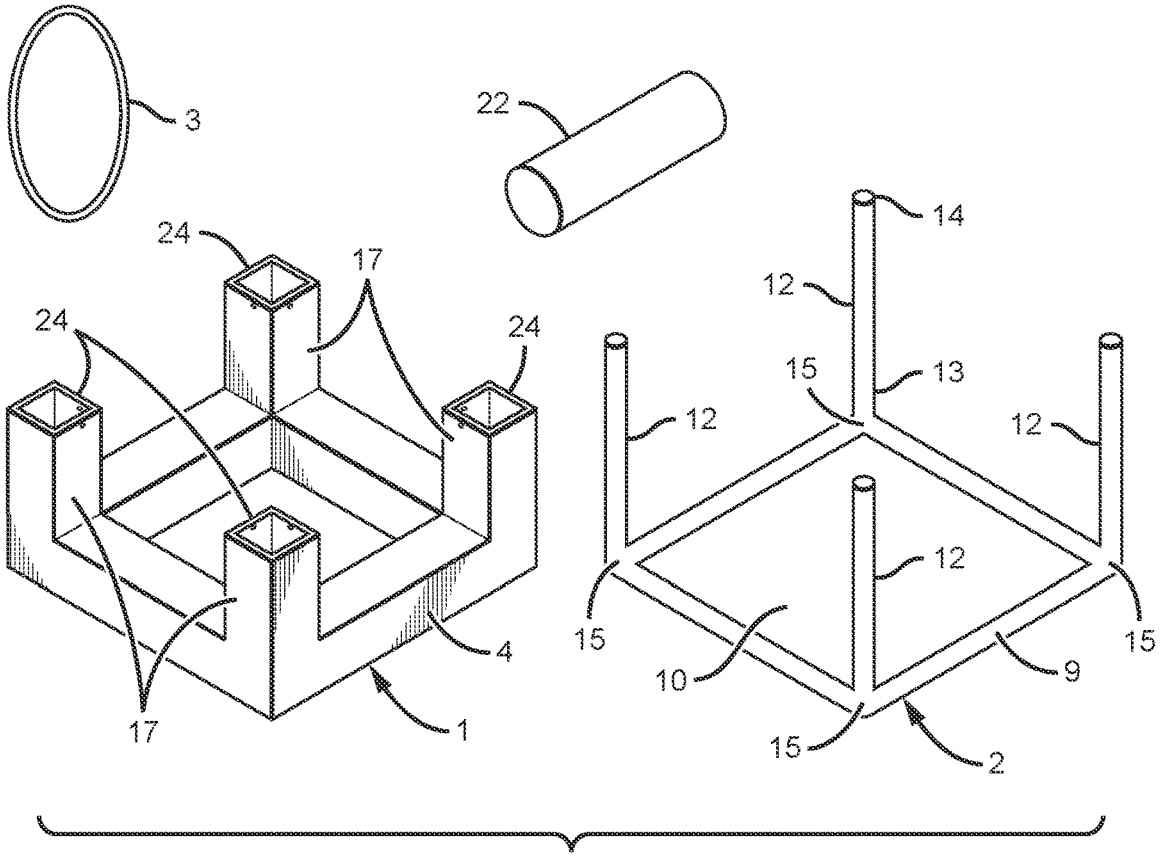

| | | | | | |
|---|---|---|---|---|---|
| 5,374,107 | A * | 12/1994 | Schnitzler | A47D 13/105 | 297/273 |
| 5,876,311 | A * | 3/1999 | Coates | A63B 21/1609 | 482/77 |
| 6,942,487 | B2 * | 9/2005 | Corbalis | A63B 69/0093 | 280/818 |
| 8,267,803 | B2 * | 9/2012 | Trapp | A47D 13/107 | 472/135 |
| 9,168,461 | B1 * | 10/2015 | Chen | A63G 9/14 | |
| 9,204,733 | B2 * | 12/2015 | Welch | A47D 13/043 | |
| 9,345,975 | B2 * | 5/2016 | Xu | A63G 9/14 | |
| 10,183,194 | B1 * | 1/2019 | Louis | A63B 5/11 | |

* cited by examiner

CONTROLLED TRAJECTORY AND OSCILLATION SYSTEM DELIVERING PENDULAR MOVEMENT OVER THE GEOMETRY OF THE SYSTEM'S STRUCTURE

CROSS-REFERENCE TO RELATED APPLICATIONS

This claims priority to Mexico patent application No. MX/a/2021/005264 filed May 4, 2021. The content of this application is incorporated herein by reference in their entirety.

BACKGROUND OF THE INVENTION

There are different types of swings, cribs, beds, furniture and other elements that move based on oscillatory movement from one or more pendulums or suspension points; the foregoing with vastly different purposes in different industries, among them, to enjoy an experience either recreational, relaxing, or simply pleasant for the user.

Pendulum movement requires a fixed point to suspend a mass by means of a rope or arm. Devices that provide the user with the experience of a pendulum movement require a structure that is invariably external to the tilting mass or object. On the other hand, any object that floats in a fluid is susceptible to oscillatory movements. Said devices that use this principle to provide the user with the experience of an oscillating movement, require a tank with a size sufficiently larger than the floating object.

These known ways to enjoy the oscillating movement require wide spaces, large structures, in some cases heavy, as well as large amounts of fluids and even additional systems to improve comfort.

Disadvantages of the prior art are solved with the system object of this invention, which allows the user to enjoy the sensation of an oscillating movement anywhere, the main advantage of the present invention being to reduce the size of the structures, achieve a versatile device, not requiring special facilities or to have permanent spaces.

Likewise, the present invention solves the problem of being able to count on greater stability by restricting the pendulums inside the posts, limiting the amplitude of the oscillation of the mass and thus its displacements and trajectories, making the system much more stable and safer.

As mentioned above, observing the need to take advantage of that movement or trajectory and so that in any object or piece of furniture you can enjoy precisely that oscillatory movement without the need for so much space, robust or external elements, and with stability, a system that allows to deliver the oscillatory movement outside the geometry of the structure that contains the pendulum is proposed, in this particular case, above said structure.

The inventive system proposed has been conceived to fully solve this problem based on two structures jointed therein, a static one with a plurality of fastening points (four) to anchor a plurality of ropes (four) to the plurality of pendulums (four); the other that rigidly couples the masses of the plurality of pendulums (four) and transforms them into a single, oscillating mass. Likewise, it also has a plurality of vertical arms (four) that replicate the oscillatory movement of the plurality of pendulums (four) in the upper part of the geometry of the system in a homogeneous and controlled manner. This is possible, since the solution proposes to deliver the oscillatory movement of the pendulum in the upper part of its geometry and recover it with any object that is placed on it.

Among other uses, it offers the user an experience similar to that of floating in a fluid, with the advantage of not having to submerge in it or come into contact with substances to which a user may be sensitive. Similarly, there is no need to temporarily confine a user to a tank that can alter the user's emotional state.

PREFERRED EMBODIMENT OF THE INVENTION

The invention refers to a system of a plurality of pendulums with controlled oscillation and trajectory with two structures of similar design (a quadrangular frame (4) with vertical posts or arms attached to the corners of the frame). A first static structure (1) having a rectangular tube profile (RTP) and a second non static structure (2) having a solid circular section profile (Round Bar) placed inside of the first static structure (1). Both are jointed therein through four ropes (3) each of said ropes with equal length, which connect, one by one, each of the four suspension points (24) with the four fastening points (16). The four suspension points (24) are located in the upper part of each one of the four posts (17) of the first static structure (1), while the four fastening points (16) are located in each one of the four nodes (15) of the second non static structure (2). The first static structure (1) is fixed resting on its frame (4), horizontally, on any flat surface, for example, the floor. The second non static structure (2) is suspended within the first static structure (1), free to move transversally and longitudinally. The four ropes (3) operate as pendulums with independent suspension points (24) and independent fastening points (16) and coupled by the frame (9) of the second non static structure (2), giving said second non static structure (2), a swinging movement which is a product of the action of the forces relating to the gravity and tension of the four ropes (3). The upper end of each one of the four arms (14), of the second non static structure (2), replicates the swinging movement of its end attached to each one of the four nodes (13), in equal magnitude, but in an opposite direction.

The first static structure (1) having a quadrangular frame (4) with a rectangular tube profile (RTP), in which its upper horizontal surface (5) must have, in each one of the four corners of the frame (4), a hole (8) of the same section and dimension as the RTP used for each one of the four posts (17); each hole (8) will allow to connect the inside of the frame (4) with the inside of each one of the four posts (17). On the horizontal lower surface (6) of said first static structure (1), the whole face (7) of the frame (4) must be retired, thus allowing the free transit of the second non static structure (2), at the moment of assembly. The four posts (17) of the first static structure (1) must have perforations (18) on both sides (19) of the RTP with a common edge (20), one perforation per side (19) located as close as possible to the end of each one of the four posts (21) and the common edge (20). The diameter of the perforations (18) is in function of the diameter of the bolts (22) that will be accommodated. The end without perforations (23) of each one of the four posts (17) is attached to the frame (4) above each hole (8) on the frame (4), making sure that each one of the four posts (17) is perpendicular to the frame's surface (10). The bolts (22) must have the mechanical properties required and sufficient to resist, without any deformation, the weight of the second non static structure (2) plus the weight of the object placed above said second non static structure.

The second non static structure (2) having a solid circular section profile (Round Bar) also form a quadrangular frame (9) with four arms (12), with each one of said four arms located in each corner, perpendicular to the frame's surface (10). The length of each one of the four arms (12) shall be longer than that of each one of the four posts (17), long enough to tower over each one of said four posts (17) when the system is assembled, thus avoiding that the object placed above the arms (12) of the second non static structure (2) gets in contact with any of the four posts (17) of the first static structure (1). The material of each one of the four ropes (3) must have all the mechanical properties required and sufficient to resist the friction and tensile, flection, torsion and cutting efforts produced by the tension and movements of the system in operation. Each one of the four ropes (3) shall have a closed ring shape.

In order to assemble the system, the second non static structure (2) is placed in a position that allows the frame (9) to be placed below and with the arms (12) pointing upwards, stringing the four ropes (3), one in each one of the four arms (12) of the second non static structure (2). Then, the second non static structure (2) is introduced in the first static structure (1) and upon completion of this assembly, each one of the four ropes (3) is pulled in a radial direction, embracing the base of each one of the four arms (13) and is also rotated, changing the direction of the starting pull, thereby surrounding the section of the elements (11) of the frame (9), continuing with the pull in a vertical direction and through the inside of each one of the four posts (17) of the first static structure (1), leading each one of the four ropes (3) to each one of the four suspension points (24), aligning the end of each one of the four ropes with the axis of each one of the perforations (18) and placing a bolt (22), with each one of the four ropes (3) mounted on the bolt (22) and the bolt being supported on the sides (19) of each one of the four posts (17). Upon completion of the process above, the assembled system is rested on the surface on which said system will be used.

For illustrative and non-limiting purposes, the RTP (Rectangular Tube Profile) and Round Bar (Solid circular section profile) have been chosen as the preferred embodiment of the system, due to their mechanical characteristics of resistance, however, the system may be embodied using several other materials (wood, MDF, acrylic, aluminum, etc.), as long as the required structural stability is preserved for its functioning. The choice of materials may change the embodiment methods, but not the essence of the system itself, which is the combination of an internal swinging structure and a fixed support and contention structure, which transfers its oscillation to an external object mounted on said structure.

DETAILED DESCRIPTION OF THE DRAWINGS

In order to complement the description and with the purpose of providing a better understanding of the characteristics of the invention, the present description is accompanied by drawings, as an integral part of the same, for illustrative and non-limiting purposes, representing the following:

FIG. 1: Shows the components of the system, a first static structure (1) with a rectangular tube profile (RTP) formed by a quadrangular frame (4) with four vertical posts (17), one on each corner of the frame (4); a second non static structure (2) with a solid circular section profile (Round Bar) with a rectangular frame (9) to rigidly couple the masses of the four pendulums located in the nodes (15) and that operate as fastening points (16) and four vertical arms (12), to transfer the controlled oscillation and trajectory produced by the four pendulums; one rope (3) with closed ring shape, illustrative of the four ropes (3) required by the system to joint both a fist static structure (1) and a second non static structure (2) thus allowing the second non static structure (2) to swing inside the first static structure (1); a bolt (22) of metallic material, illustrative of the four bolts (22) required by the system to form the four suspension points (24), in which the four ropes (3) are mounted.

Figure 2A:
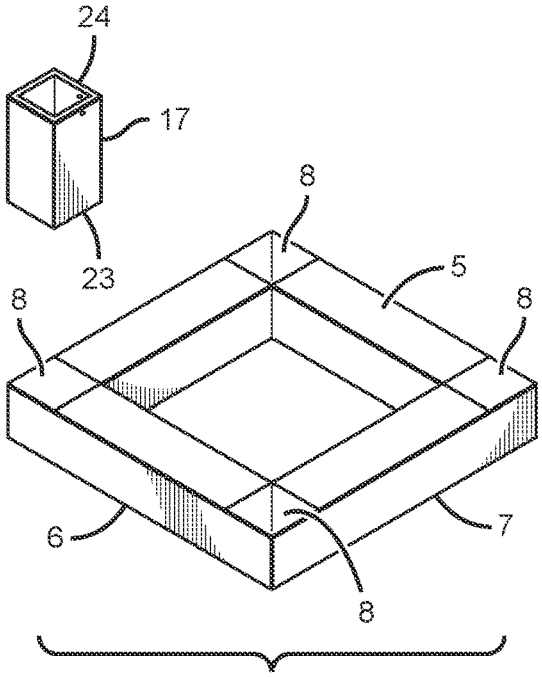
Figure 2B:
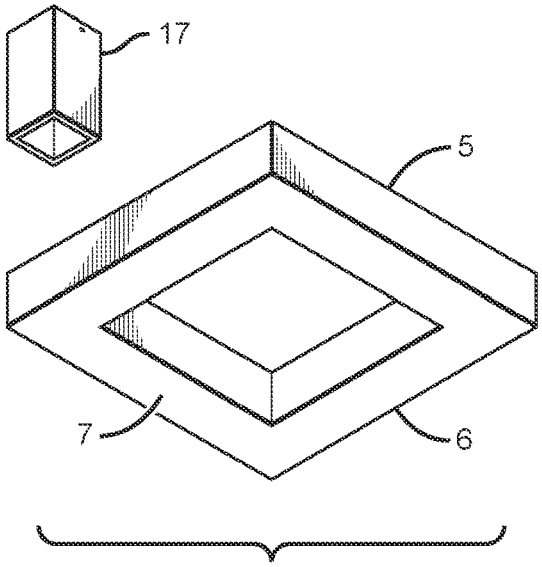

FIGS. 2A and 2B: As shown in FIG. 2A, the frame (4) of the first static structure (1) with a rectangular tube profile (RTP) requires four holes (8) to connect the inside of each one of the four posts (17) with the inside of the frame (4), located in the four corners of the frame (4); likewise, as shown in FIG. 2B, in the lower horizontal surface (6) it is necessary to retire the whole face of the frame (4) in order to allow the free pass of the second non static structure (2) at the moment of assembling the system.

Figure 3:
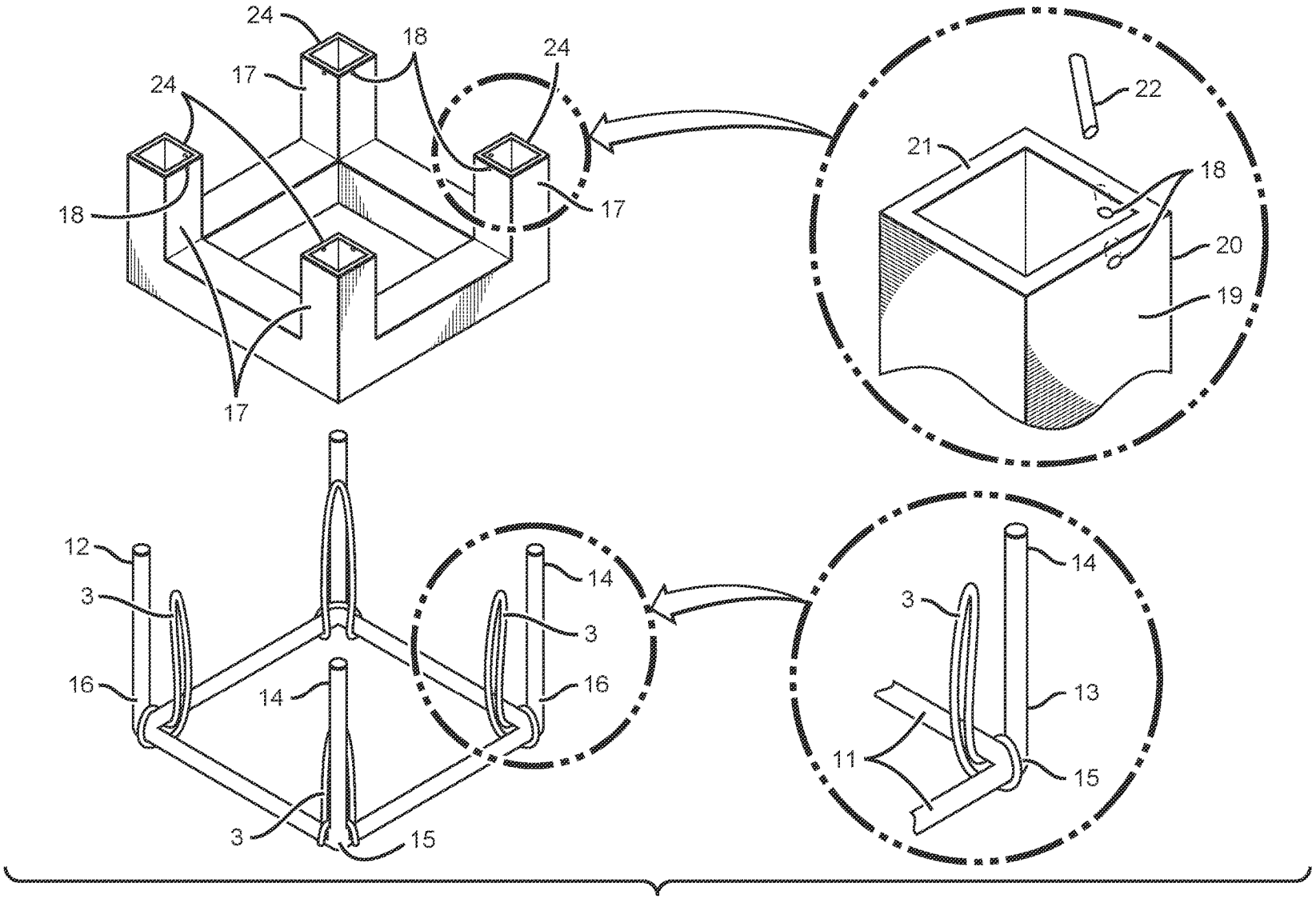

FIG. 3: The system's components ready to conclude the assembly, the second non static structure (2) below the first static structure (1) with the four arms (12) of the second non static structure (2) in line with the axes of each one of the four posts (17) of the first static structure (1). The four ropes (3), each surrounding the base of one of the four arms (12) and the elements (11) of the frame (9) in the fastening point (16) directed to each one of the four points of suspension (24) to be aligned with the axis of the perforations (18) and conclude with the placement of the four bolts (22).

Figure 4:
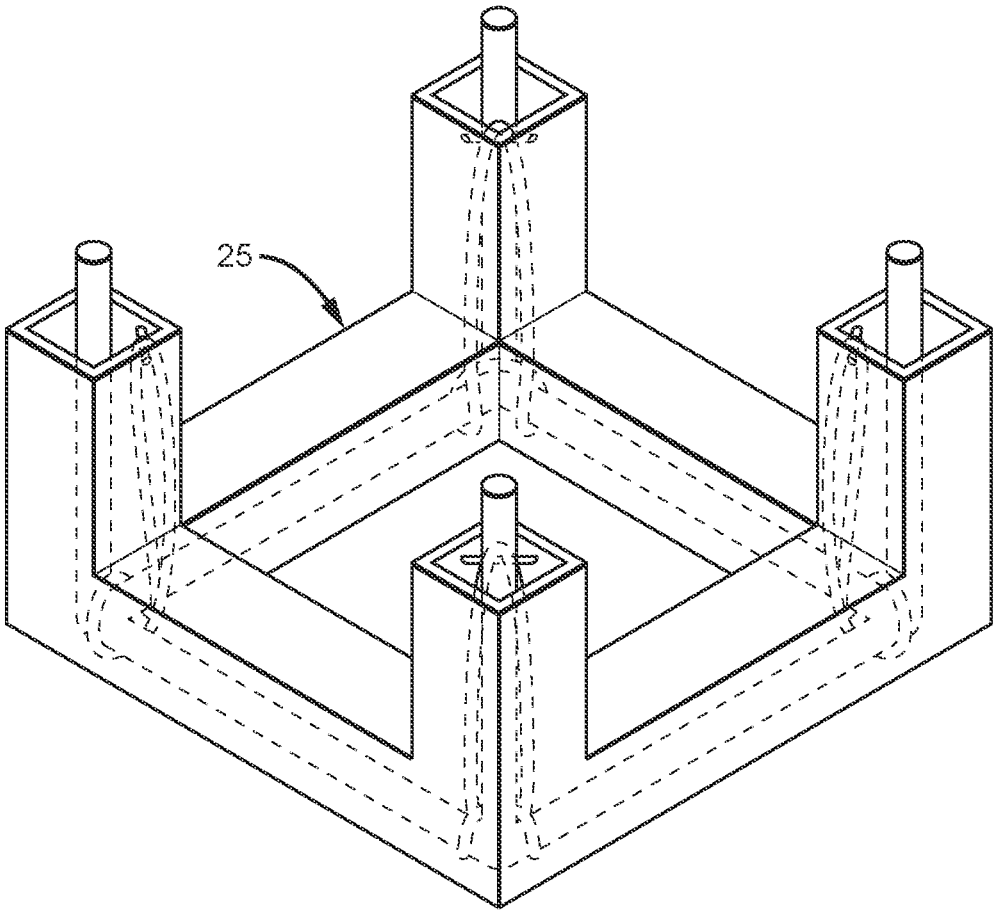

FIG. 4: With all the elements in position and the bolts (22) in place, the system (25) is ready to function, the four ropes are mounted on the bolts (22), in the four suspension points (24) and surrounding the frame (9) that couples the masses of the four pendulums at the four fastening points (16), forming the articulations among the first static structure (1) and the second non static structure (2). With the four tensed ropes (3), the frame (9) becomes the oscillating mass with a limited trajectory inside the first static structure (1) and which throughout each one of the four arms (12) shall transfer, in a homogeneous and controlled manner, the oscillation and trajectory to the upper part of the system (25) where it shall replicate the swing with equal magnitude and trajectory, but in an opposite direction to the frame's (9). The upper end (14) of the four arms (12) are in condition to receive the intended object or piece of furniture in order to provide it with a controlled oscillation and trajectory.

Having described our invention above, we consider the novelty and claim as our property the contents of the following claims:

1. A system of a plurality of pendulums with controlled oscillation and trajectory, said system comprising:

two structures jointed therein, the two structures comprising a static structure and a non-static structure, the non-static structure comprises four vertical arms that form the plurality of pendulums, wherein the static structure comprises a plurality of fastening points to anchor a plurality of ropes to said plurality of pendulums, and the non-static structure rigidly couples said plurality of pendulums and transforms said plurality of pendulums into a single, oscillating mass, wherein the static structure comprises a rectangular base having a tube profile, wherein the rectangular base comprises four horizontal tubular members, wherein the static structure comprises four posts extending from an upper surface of the rectangular base, and the non-static structure comprises four horizontal rods, each horizontal rod of the four horizontal rods is positioned between two adjacent vertical arms of the four vertical arms such that a first vertical arm of the four vertical arms is connected to a first adjacent vertical arm of the two adjacent vertical arms via a first horizontal rod of the four horizontal rods and the first vertical arm of the four vertical arms is connected to a second adjacent vertical arm of the two adjacent vertical arms via a second horizontal rod of the four horizontal rods, wherein each of the four vertical arms is positioned within and connected to an inside of each post of the four posts via a rope of the plurality of ropes, and the four horizontal rods are positioned within the rectangular base, and the four vertical arms are configured to replicate oscillatory movement of said plurality of pendulums in an upper part of a geometry of said system in a homogeneous and controlled manner.

2. The system of claim 1, each rope of the plurality of ropes have an equal distance to one another and are connected by four points of suspension to four fastening points and wherein the four points of suspension are placed in an upper part of each one of the four posts of the static structure, while each of the four fastening points are located in each node of the non-static structure, and wherein the static structure is static, resting horizontally on its rectangular base, and the non-static structure is suspended inside the static structure, free to move transversally and longitudinally.

3. The system of claim 1, wherein the plurality of ropes each include independent points of suspension and independent fastening points and wherein masses are coupled by the four horizontal rods and four vertical arms of the non-static structure.

4. The system of claim 1, wherein, in each of four corners of the rectangular base, there is a hole having same section and dimension as the four posts, each of said holes connect an inside of the rectangular base with an inside of each one of the four posts, each of said four posts have perforations on two sides, said perforations sharing a common edge, one perforation of said perforations per side placed as close as possible to an end of each post and to the common edge, and in which an edge without a perforation of each one of the four posts is attached to one of the rectangular base on each hole in the rectangular base, thus ensuring that each one of the four posts is perpendicular to an upper surface of the rectangular base.

5. The system of claim 1, wherein each one of the four vertical arms is placed in each of four corners of the non-static structure, perpendicular to an upper surface of the rectangular base, and in which a length of each of the four vertical arms is longer than a length of each of the four posts, long enough to tower above each one of the four posts when the system has been assembled in order to prevent an object, being placed above the four vertical arms of the non-static structure, from contacting any of the four posts of the static structure.

6. The system of claim 1, wherein each of the four vertical arms are pointing upwards, and wherein each rope of the plurality of ropes is mounted on a bolt and the bolt is supported on a side of each one of the four posts.

7. The system of claim 1 wherein the plurality of pendulums does not require suspension points external to the system to obtain a controlled oscillation and trajectory.

* * * * *